United States Patent [19]

Cochran et al.

[11] 4,405,280

[45] Sep. 20, 1983

[54] MODULAR LOADER FRAME STRUCTURE

[75] Inventors: Gary L. Cochran; James E. Dawson; Gary D. Stromberg, all of Burlington, Iowa

[73] Assignee: J. I. Case Company, Racine, Wis.

[21] Appl. No.: 351,067

[22] Filed: Feb. 22, 1982

[51] Int. Cl.[3] ..... B66F 9/075

[52] U.S. Cl. ..... 414/685; 180/89.13; 180/89.16; 180/208; 296/197; 414/914

[58] Field of Search ..... 212/182; 296/197, 203; 180/89.13, 89.16, 313, 208, 298; 414/697, 680, 685, 914

[56] References Cited

U.S. PATENT DOCUMENTS 3,895,728 7/1975 Heggen ..... 414/697
4,055,262 10/1977 Bauer et al. ..... 414/697

FOREIGN PATENT DOCUMENTS 2516486 10/1976 Fed. Rep. of Germany ... 180/89.16

*Primary Examiner*—Robert J. Spar
*Assistant Examiner*—Terrance L. Siemens
*Attorney, Agent, or Firm*—Cullen, Sloman, Cantor, Grauer, Scott & Rutherford

[57] ABSTRACT

A modular machine including several removable components which are structurally interconnected in a manner to result in a rigid unit which is inexpensive to manufacture and easy to service or repair. The modular machine includes as its basic components a base frame assembly, an operator's control station, and a cab assembly. The base frame assembly comprises an open frame construction including opposed rectangular end members and opposed hollow rectangular side members. Ground-engaging wheels are mounted to the side members by using a unitized axle assembly including a hub and sprocket which extends into the interior of a side member. A fluid motor is mounted to the inner wall of each side member for driving the ground-engaging wheels connected to that side member. The operator's control station includes a front wall portion and rearwardly extending side wall portions. A generally U-shaped frame extends downwardly from the front and side wall portions for engagement within a complementary cavity formed by stepped inner walls on the side members of the base frame assembly. The cab assembly consists of an operator's seat attached to a box-like frame with the box-like frame being pivotally attached to the operator's control station. The cab assembly may be conveniently removed from the operator's control station or rotated to an out-of-the-way position thereby permitting complete access to the interior of the operator's control station. The base frame assembly, operator's control station and cab assembly may be conveniently disassembled to permit complete access to all parts of the machine for easy servicing, repair or replacement.

3 Claims, 4 Drawing Figures

MODULAR LOADER FRAME STRUCTURE

BACKGROUND OF THE INVENTION

The present invention relates to machines that accommodate various attachments for handling material, such as front end loaders, dozer blades, forklifts, and the like.

The use of machines for handling material has been known for many years. In environments such as warehouses, limited space requirements make it mandatory that the machine be compact, highly maneuverable, and lightweight. Units of this type and of the general character to which this invention is related are shown in Gilette et al U.S. Pat. No. 3,984,141, and Huber U.S. Pat. No. 3,850,473, assigned to the assignee of the present invention.

Due to the compactness of the prior art machines heretofore mentioned, assembly, servicing and repair work has been time-consuming and difficult because many of the machine parts are not readily accessible. Thus, there has been a need for a machine having frame components which permit an operator easy access to the machine parts for servicing, repair or replacement work. Further, there has been a need for a simple unit that can be readily manufactured without the use of special tools, fasteners, or materials.

It is, therefore, an object of the present invention to provide a modular machine having removable components which permit complete access to all machine parts for servicing or repair. It is a further object of the present invention to provide a structural inter-relationship between the removable components such that a simple unit may be readily manufactured without the use of special tools, fasteners, or materials.

SUMMARY OF THE INVENTION

In accordance with the present invention, a modular skid-steer loader is provided having removable components which are structurally inter-related to provide a simple unit which may be completely torn down for servicing or repair work to the machine parts.

The modular skid-steer loader of the present invention has three basic components including a base frame assembly, an operator's control station, and a cab assembly. The base frame assembly is supported by ground-engaging wheels and an engine is mounted on the rear end thereof. Vertical stanchions extend above the base frame assembly adjacent the rear end thereof on opposite sides of the engine. Lift arms are pivotally mounted adjacent the upper end of each stanchion.

The lift arms extend forwardly along opposite sides of the operator's control station and have front portions directed downwardly adjacent the front end of the base frame assembly. A material handling bucket is pivotally connected to the forward ends of the lift arm portions. The lift arms may be raised and lowered by lift cylinders, each lift cylinder being pivotally connected between a lift arm and a vertical stanchion.

The base frame assembly comprises an open frame construction including opposed rectangular end members and opposed hollow rectangular side members. Each wheel is mounted to a respective side member by means of an unitized axle assembly including a hub and sprocket which extends into the interior of the side member. A fluid motor is mounted to the inner wall of each side member for driving the wheels connected to that side member. A chain drive is mounted within the hollow side member for interconnecting the sprockets in a respective side member with the fluid drive motor.

The operator's control station includes a front wall portion and rearwardly extending side wall portions. A generally U-shaped frame extends downwardly from the front and side wall portions for engagement within a complementary cavity formed by stepped inner walls on the side members of the base frame assembly. The U-shaped frame also provides space for the operator's legs and feet when the cab assembly is positioned over the operator's control station.

The operator's control station further includes manually operable control handles which are connected by means of a suitable linkage to a control valve for permitting the operator to control forward, reverse, and steering movements of the machine and actuation of the lift cylinders. The control station is installed on the base frame assembly by fastening the bottoms of the side wall portions of the control station against the tops of the base frame side members with rubber isolation mounts.

The cab assembly consists of an operator's seat attached to a box-like frame with the box-like frame being pivotally attached to support brackets on the operator's control station for permitting movement of the cab assembly about a transverse horizontal axis. The cab assembly may be conveniently removed from the operator's control station or rotated to an out-of-the-way position, thereby permitting complete access into the interior of the operator's control station.

According to the present invention, the skid-steer loader includes several removable modules or components, as described, which may be conveniently disassembled to permit complete access to all parts of the machine for easy servicing, repair or replacement. Each axle assembly, for example, may be removed as a complete unit for servicing, repair or replacement by uncoupling its hub from the base frame side member. The operator's control station may be removed by lifting its frame out of the cavity formed in the base frame assembly thereby permitting easy access to the fluid motors, control valve, and fluid pumps mounted on the base frame assembly as well as the hoses and other connections between these fluid driving elements. Further, access to the operator's control station may be had by rotating the cab assembly to an out-of-the-way position or removing the cab assembly, thereby premitting servicing or repair work to be done on the control handles and actuating linkage mounted to the control station.

Thus, because of the structural inter-relationship between the various components, the loader of the present invention provides a simple unit that can be readily manufactured without the use of special tools, fasteners, or materials. The entire frame structure and body of the loader may be produced with lightweight sheet metal and the like that is interconnected in such a manner to result in a rigid unit which is inexpensive to manufacture and easy to service or repair.

Other advantages and meritorious features of the modular skid-steer loader of the present invention will be more fully understood from the following description of the preferred embodiment, the appended claims, and the drawings, a brief description of which follows.

DETAILED DESCRIPTION OF THE INVENTION

A preferred embodiment of an earth-working machine made in accordance with the teachings of the present invention is illustrated in FIGS. 1-4.

Figures 1, 2:
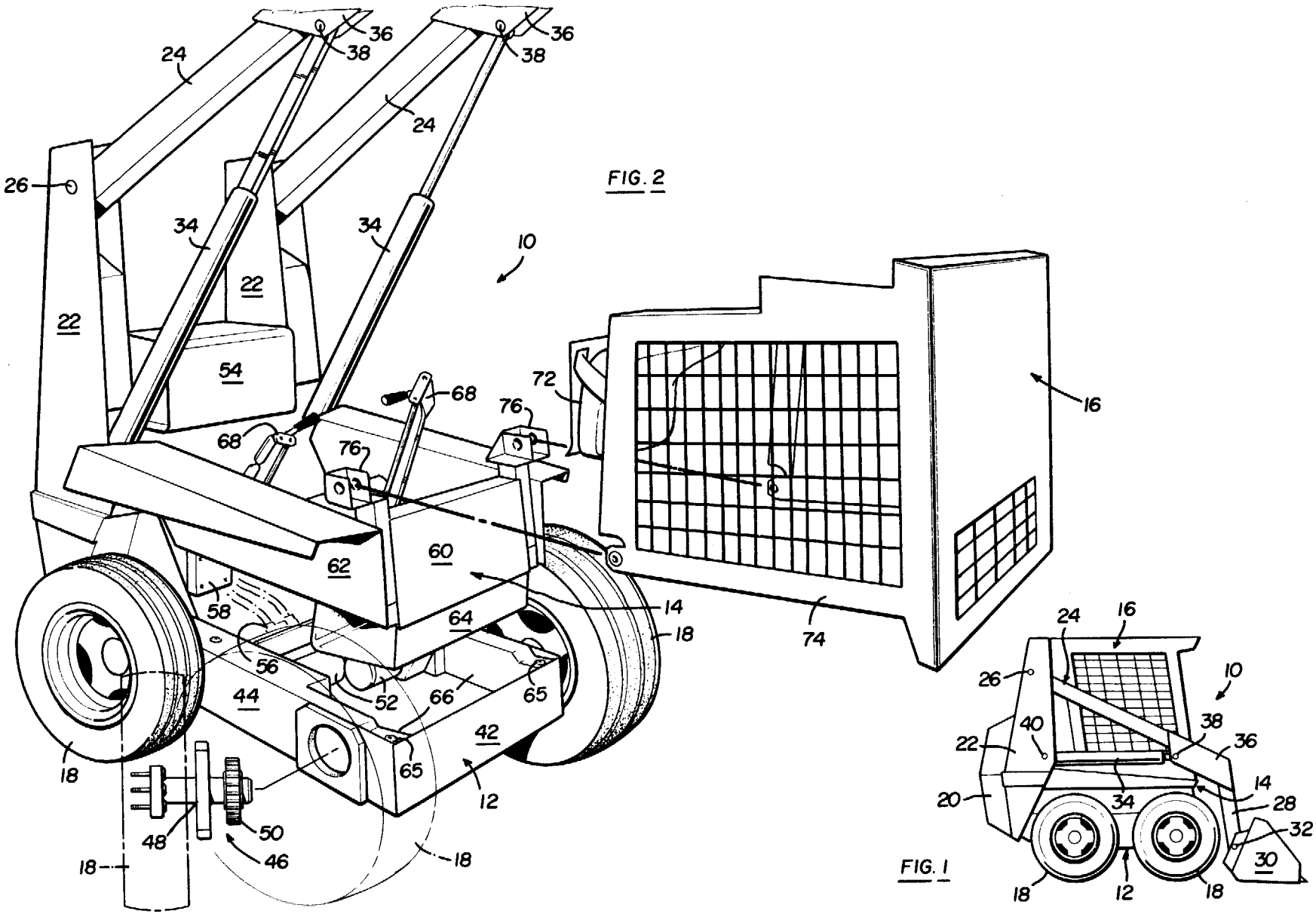
FIG. 1 is a side elevational view of the modular skid-steer loader of the present invention.
FIG. 2 is a perspective view of the modular skid-steer loader showing the removable components of the loader.

FIGS. 1-2 of the drawings show the modular skid-steer loader 10 of the present invention having three basic components including a base frame assembly 12, an operator's control station 14, and a cab assembly 16. Frame assembly 12 is supported by ground-engaging wheels 18 and an engine 20 is mounted on the rear end thereof. Vertical stanchions 22 extend above base frame assembly 12 adjacent the rear end thereof on opposite sides of engine 20. Lift arms 24 are pivotally mounted by pivot pins 26 adjacent the upper end of each stanchion 22.

The lift arms 24 extend forwardly along opposite sides of operator's control station 14 and have front portions 28 directed downwardly adjacent the front end of base frame assembly 12. A material handling bucket 30 is pivotally connected to the forward ends of lift arm portions 28 by means of pins 32. Lift arms 24 may be raised and lowered by fluid rams 34, each fluid ram being pivotally connected between lift arm gusset plates 36 and stanchion 22 by pins 38 and 40.

Figure 3:
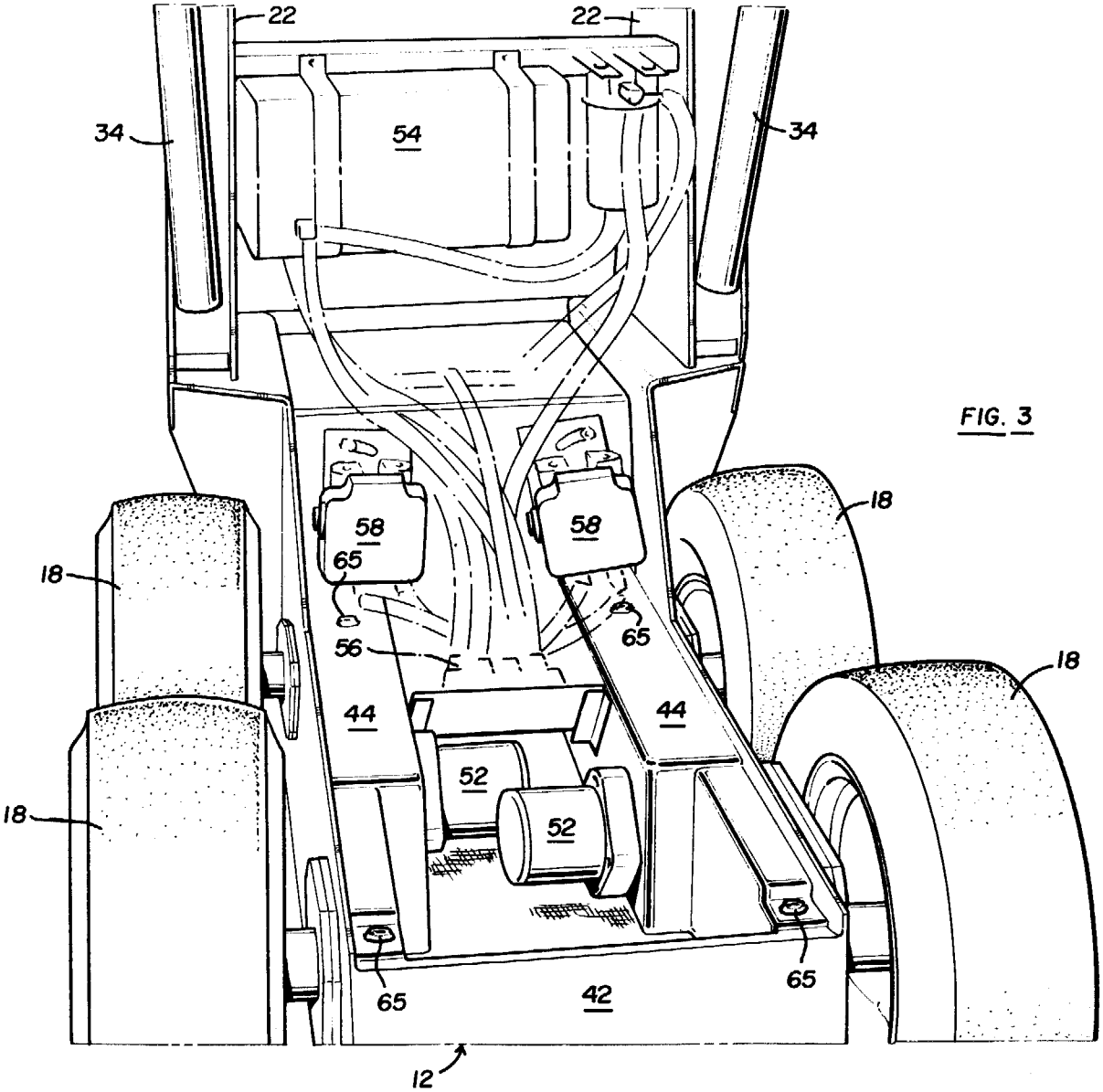
FIG. 3 is a perspective view of the base frame assembly of the loader.

Referring to FIGS. 2-3, base frame assembly 12 comprises an open frame construction including opposed rectangular end members 42 and opposed hollow rectangular side members 44. Each wheel 18 is mounted to a respective side member 44 by means of a unitized axle assembly 46 (FIG. 2) including a hub 48 and sprocket 50 which extends into the interior of the side member. A fluid motor 52 is mounted to the inner wall of each side member 44 for driving the wheels 18 connected to that side member. A chain drive (not shown) is mounted within the hollow side member 44 for interconnecting the sprockets 18 in a respective side member with a drive motor 52. Fluid motors 52 are actuated for driving wheels 18 by a conventional hydraulic circuit including fluid reservoir 54, control valve 56, and fluid pumps 58 which are powered by engine 20.

Figure 4:
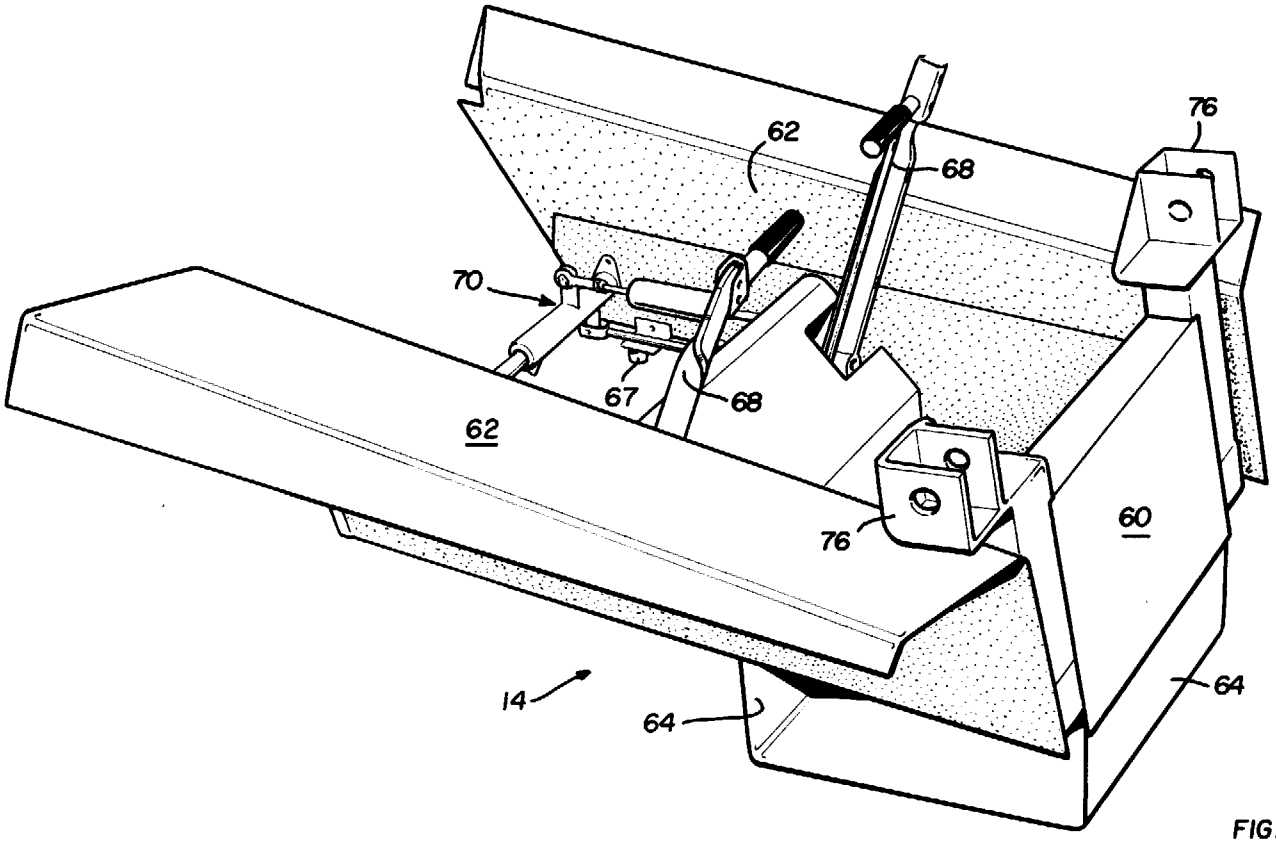
FIG. 4 is a perspective view of the operator's control station.

The operator's control station 14, as shown in FIGS. 2 and 4, includes a front wall portion 60 and rearwardly extending side wall portions 62. A generally U-shaped frame 64 extends downwardly from front and side wall portions 60, 62 for engagement within a complementary cavity 66 formed by the stepped inner walls on side members 44 of base frame assembly 12. The U-shaped frame 64 also provides space for the operator's legs and feet when the cab assembly 16 is in the position shown in FIG. 1.

Control station 14 further includes manually operable control handles 68 which are connected by means of a suitable linkage 70 to control valve 56 in a conventional manner for permitting the operator to control forward, reverse, and steering movements of the machine and actuation of lift cylinders 34. Control station 14 is installed on base frame assembly 12 by fastening the bottoms of side wall portions 62 against the tops of members 44 with rubber isolation mounts 65 and 67.

Referring to FIG. 2, cab assembly 16 consists of an operator's seat 72 attached to a box-like frame 74 with frame 74 being pivotally attached to support brackets 76 on operator's control station 14 for movement about a transverse horizontal axis. Cab assembly 16 may be conveniently removed from loader 10 as shown in FIG. 2 or rotated on support brackets 76 to an out-of-the-way position thereby permitting complete access to the interior of control station 14.

According to the present invention, loader 10 includes several removable modules or components 12, 14, and 16 which may be conveniently disassembled to permit complete access to all parts of the machine for easy servicing, repair or replacement. Each axle assembly 46, for example, may be removed as a complete unit for servicing, repair or replacement by uncoupling hub 48 from side member 44. Operator's station 14 may be removed by lifting frame 64 out of the cavity 66 formed in frame assembly 12 thereby permitting easy access to fluid motors 52, control valve 56, and fluid pumps 58 as well as the hoses and other connections between these fluid driving elements. Further, access to control station 14 may be had by rotating cab assembly 16 to an out-of-the-way position or removing cab assembly 16 thereby permitting service or repair work to be done on control handles 68 and linkage 70.

Thus, because of the structural inter-relationship between the various components, the loader of the present invention provides a simple unit that can be readily manufactured without the use of special tools, fasteners or materials. The entire frame structure and body of loader 10 may be produced with lightweight sheet metal and the like that is interconnected in such a manner to result in a rigid unit which is inexpensive to manufacture and easy to service or repair.

It will be apparent to those skilled in the art that the foregoing disclosure is exemplary in nature rather than limiting, the invention being limited only by the appended claims.

We claim:

1. A modular machine having a plurality of components which are structurally interconnected for convenient assembly, disassembly, servicing or repair, said modular machine comprising a base frame assembly, an operator's control station, and a cab assembly;

said base frame assembly including opposed end members and opposed side members forming an open frame construction with an engine mounted on one end thereof, said base frame side members including stepped inner walls for forming a cavity, vertical stanchions mounted to said base frame assembly and extending above said base frame assembly on opposite sides of said engine, lift arms pivotally mounted at one end to said stanchions and a material handling implement pivotally connected to the opposite end of said lift arms, at least one axle assembly mounted to each side member and a fluid motor mounted to each side member for driving said axle assembly;

said operator's control station including a front wall portion and rearwardly extending side wall portions, a frame extending downwardly from said front and side wall portions for engagement within the cavity formed by said base frame side members, said operator's control station being removably installed on said base frame assembly by abutting said control station side wall portions against said base frame side members and inserting said frame into said base frame cavity;

said cab assembly including an operator's seat attached to a box-like frame with said box-like frame being pivotally attached to said operator's control station for movement about a horizontal axis, said cab assembly being rotatable to a position permitting complete access into the interior of said operator's control station; and said base frame assembly, operator's control station, and cab assembly being removable from each other to permit complete access to all parts of said machine for easy servicing, repair or replacement.

2. The modular machine as defined in claim 1 wherein said base frame side members being hollow and said axle assembly comprising an integral unit including a hub and sprocket, said hub being releasably mounted to a base frame side member with said sprocket extending into the interior of the side member, said fluid motor being drivingly connected to said sprocket.

3. The modular machine as defined in claim 1 wherein said base frame assembly including at least one fluid pump and a control valve connected between said fluid pump and fluid motor, said operator's control station including control handles which are operatively connected to said control valve for permitting an operator to control forward, reverse and steering movements of the machine, said operator's control station being removable from said base frame assembly thereby permitting complete access to said fluid motor, fluid pump, and control valve for servicing or repair.

* * * * *